US008544607B2

(12) United States Patent
Iden

(10) Patent No.: US 8,544,607 B2
(45) Date of Patent: Oct. 1, 2013

(54) RAIL LUBRICATION AND/OR FRICTION MODIFICATION SYSTEM WITHIN A NON-FREIGHT CARRYING INTERMODAL CONTAINER

(75) Inventor: Michael E. Iden, Kildeer, IL (US)

(73) Assignee: Union Pacific Railroad Company, Omaha, NE (US)

( * ) Notice: Subject to any disclaimer, the term of this patent is extended or adjusted under 35 U.S.C. 154(b) by 636 days.

(21) Appl. No.: 12/558,472

(22) Filed: Sep. 11, 2009

(65) Prior Publication Data

US 2011/0061973 A1 Mar. 17, 2011

(51) Int. Cl.
*B61K 3/00* (2006.01)

(52) U.S. Cl.
USPC ..... 184/3.2

(58) Field of Classification Search
USPC ..... 184/3.1, 3.2, 5; 248/206.5
See application file for complete search history.

(56) References Cited

U.S. PATENT DOCUMENTS

| | | | | |
|---|---|---|---|---|
| RE12,209 | E | 3/1904 | Hawkins | |
| 4,287,676 | A * | 9/1981 | Weinhaus | 40/661.01 |
| 4,393,957 | A | 7/1983 | Hawthorne | |
| 4,492,355 | A * | 1/1985 | Bylin | 248/206.5 |
| 4,930,600 | A | 6/1990 | Kumar et al. | |
| 5,896,947 | A | 4/1999 | Kumar | |
| 6,893,058 | B2 | 5/2005 | Kumar et al. | |
| 7,357,427 | B2 | 4/2008 | Eadie et al. | |
| 7,513,336 | B2 * | 4/2009 | Hsu et al. | 184/5 |

OTHER PUBLICATIONS

ISO "Freight containers—Coding, identification and marking". ISO 6346, 3rd ed. Switzerland: International Organization for Standardization, Dec. 1, 1995.

ISO "Series 1 frieght containers—Classification, dimensions and ratings". ISO 668, 5th ed. Switzerland: International Organization for Standardization, Dec. 15, 1995.

ISO "Series 1 frieght containers—Corner fittings—Specification". ISO 1161, 4th ed. Switzerland: International Organization for Standardization, Dec. 15, 1984.

Technical Committee ISO "Series 1 frieght containers—Corner fittings—Specification" Technical Corrigendum 1. ISO 1161. Switzerland: International Organization for Standardization, 1990.

Kelsan Freight Car Solution. Advertisement. Kelsan Technologies Corp. 2005.

"TracGlide On-board, top-of-rail friction management system". Timken: Where You Turn. 2007. <http://www.timken.com/en-us/solutions/rail/Documents/mhTracGlide13_12_20.pdf>.

* cited by examiner

*Primary Examiner* — William E Dondero
*Assistant Examiner* — Robert T Reese
(74) *Attorney, Agent, or Firm* — Pillsbury Winthrop Shaw Pittman LLP

(57) ABSTRACT

A lubrication system is contained within the body of a non-freight carrying intermodal container for lubricating a pair of rails of a train track. The lubrication system includes at least a lubricant holding tank for holding lubricant, a lubricant dispensing pump, and one or more hoses connected to the lubricant holding tank for directing a flow of the lubricant to one or more nozzles. The nozzles are positioned to distribute lubricant to at least a top of the pair of rails. The nozzles may be mounted with respect to a car body, floor, or axle trucks. The container is easily moved and repaired via its corner fittings, for example.

8 Claims, 12 Drawing Sheets

RAIL LUBRICATION AND/OR FRICTION MODIFICATION SYSTEM WITHIN A NON-FREIGHT CARRYING INTERMODAL CONTAINER

BACKGROUND

1. Field of Invention

The present invention is generally related to a lubrication and/or friction modification system provided within a non-freight carrying intermodal container.

2. Description of Related Art

Typically, rail lubricant is applied on rails of a train track (e.g., such as on top of the rails) such that non-powered wheels of one or more trailing car(s) are in contact with and pulled along the lubricated rails. This is because the rotation of the wheels of the car(s) is caused by the pulling/pushing of one or more powered locomotives. Otherwise, if rail lubricant is dispensed underneath the powered wheels of working locomotives, the risk of locomotive underperformance and train stall increases.

For at least the past 20 years, the railroad industry has focused on installing rail lubrication equipment onboard locomotives and onboard modified freight cars of a train. Generally, locomotive-mounted schemes require careful management when placing such locomotives within a length of the train. For example, if a front of the train includes two or more locomotives, i.e., a locomotive consist, the locomotive with the lubrication equipment is typically placed at a rear of locomotive consist, and the lubrication system only at the rear end of the rearmost locomotive is activated, so that the rails are correctly lubricated. Freight car-mounted schemes are similarly restrictive. For example, the lubrication equipment must be positioned in a freight car that is directly behind the locomotive(s) in order to dispense lubricant in a proper and effective manner.

Additionally, using onboard lubrication devices on locomotives and traditional freight cars can be expensive. If onboard lubrication equipment is installed onboard locomotives, generally all of the locomotives to be placed in a length of the train will have to be equipped with onboard rail lubrication systems in order to provide effective coverage of the rails with lubricant. For example, if lubrication equipment is to be installed on a three (3) unit locomotive consist that is going to be used to pull freight cars, every locomotive in the consist generally will be configured and maintained in a configuration such that any of the locomotives may be positioned as a lead locomotive, even though only the third or rearmost locomotive in the consist will be used for rail lubrication when the train is moving. This can be quite expensive because of the costs for installing lubrication equipment on each locomotive even though only the one unit in consist (i.e., rear) is used for dispensing the lubricant.

Furthermore, the lubrication equipment has to be mounted on the locomotive such that it does not interfere with locomotive dispatch and management activities. This can be cumbersome.

If onboard lubrication equipment is installed in a dedicated freight car, the installation costs may be lower than the locomotive installation costs, but the freight car with the lubrication equipment still must be properly positioned for effective rail lubrication (i.e., directly behind the locomotive(s)). This may be deemed difficult, as it will most likely require switching locomotive activities and/or switching positions of the freight car within the length of the train at origin and destination terminals.

Moreover, lubrication equipment mounted in/on locomotives and/or freight cars is highly unreliable and requires extensive equipment management controls. For example, locomotive-mounted schemes tend to subject rail lubrication equipment to high levels of shock-and-vibration when mounted on the truck assemblies at/around the traction motors. Similar shock and/or vibration may also occur to the lubrication equipment in freight car-mounted schemes. As such, the costs for installing, running, and repairing (e.g., repairing the lubricant equipment or one or more parts of the containing device itself) the lubrication equipment on locomotives and freight cars are high and can be expensive.

SUMMARY

One aspect of the invention provides a non-freight carrying intermodal container with a lubrication system therein for lubricating a pair of rails of a train track. The a non-freight carrying intermodal container includes: a body formed from a top wall, a bottom wall, front wall, back wall, and side walls connected by a frame. The body is configured to house the lubrication system. The container also includes corner fittings at each corner, which have a plurality of connection openings. The lubrication system has at least a lubricant holding tank inside of the body for holding lubricant, a lubricant dispensing pump for pumping lubricant from the tank, and one or more hoses connected to the lubricant holding tank for directing a flow of the lubricant to one or more nozzles connected to the one or more hoses. The nozzles are configured to distribute lubricant to at least a top of the pair of rails.

Another aspect of the invention includes a lubrication system for lubricating a pair of rails of a train track using a non-freight carrying, intermodal container. The container has a body comprising a top wall, a bottom wall, front wall, back wall, and side walls connected by a frame. The container also has corner fittings at each corner, which have a plurality of connection openings. The lubrication system has at least a lubricant holding tank inside of the body of the container for holding lubricant, a lubricant dispensing tank for pumping lubricant from the tank, and one or more hoses connected to the lubricant holding tank for directing a flow of the lubricant to one or more nozzles connected to the one or more hoses. At least the nozzles are configured to distribute lubricant to at least a top of the pair of rails.

Other objects, features, and advantages of the present invention will become apparent from the following detailed description, the accompanying drawings, and the appended claims.

DETAILED DESCRIPTION

It is a goal of the present invention to apply lubricant or friction modifiers to a pair of rails of a train track during transportation of train along the track using a modified intermodal container with a lubrication system therein. Though intermodal containers are designed to be used in more than one form of transportation, e.g., railway, waterway, or highway, the embodiments below are herein described pertaining to their use on a railway.

As noted above, existing applications of onboard rail lubrication equipment focus on installing the equipment onboard either diesel-electric locomotives or rail freight cars. However, the present invention of using onboard lubrication equipment that is installed inside of a modified intermodal (ISO) container would reduce costs of installing and maintenance of the lubrication system, enable or increase the handling of the container using existing equipment, (i.e., container cranes, spreaders, lift systems, chasses and tractors) and reduce labor costs as well (e.g., no yard switcher locomotive or crew activities are required). The container is a non-freight carrying container, and therefore non-revenue generating (i.e., items or goods are not transported therein). Additional advantages for such a track lubricator intermodal container will become further evident throughout the description below.

Figure 1:
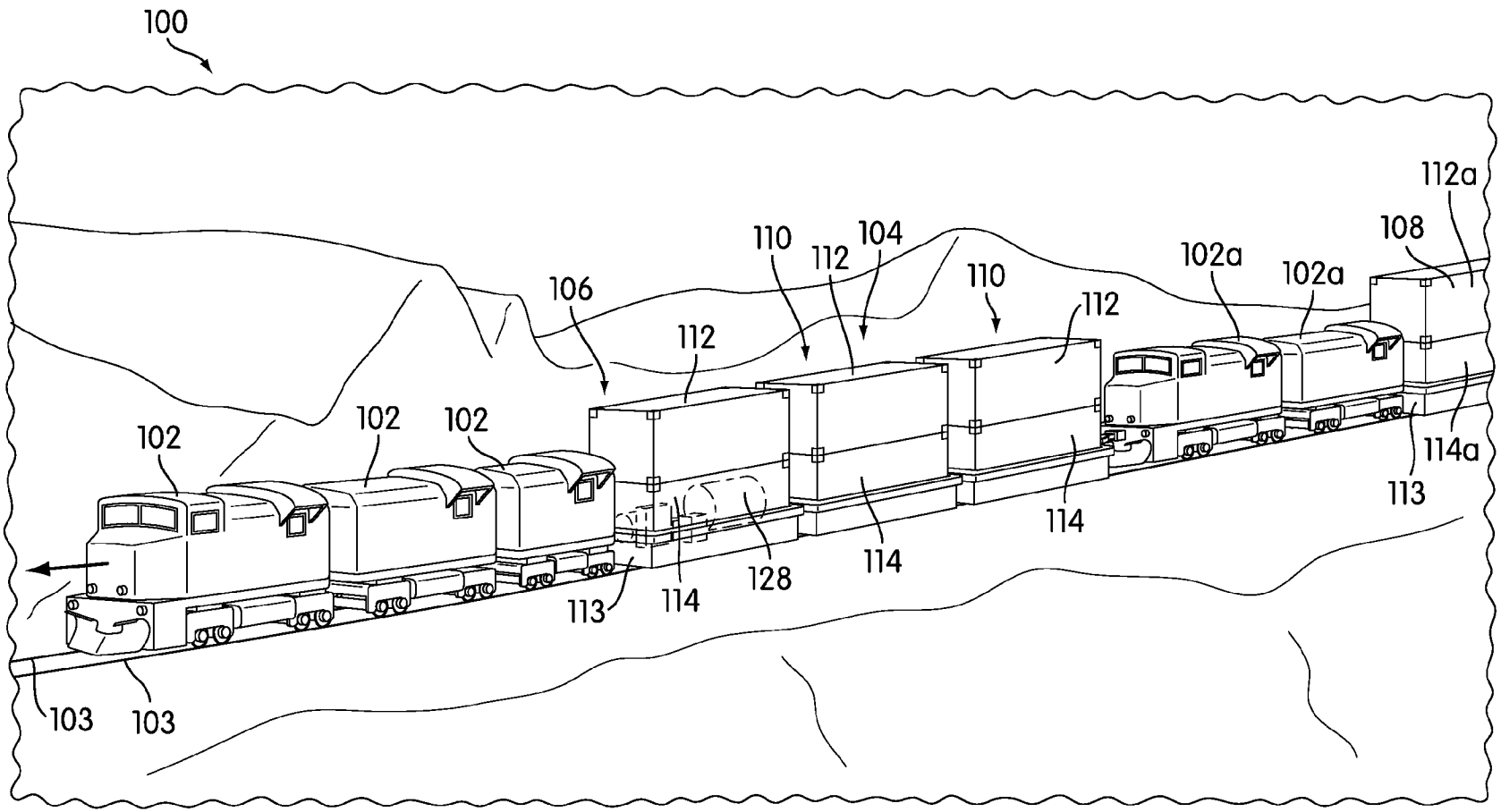
FIG. 1 illustrates a train comprising a locomotive pulling a series of rail cars carrying containers and a track lubricator, non-freight carrying, intermodal container in accordance with an embodiment of the present invention.

Referring now more particularly to the drawings, FIG. 1 illustrates a train 100 comprising at least one leading locomotive 102 pulling a series 104 (or set) of intermodal containers in cars 113 on railroad tracks or a pair of rails 103. In some cases, as is shown and described below, the intermodal containers may be stacked. A "car" may be generally referred to as a body with axle trucks 115 having track engaging wheels 109 and couplings 136 that is connected in a train 100 for transporting items, and will become more evident by the description below.

In some cases, train 100 is used to transport goods, cargo, and other items that are of higher weight. Generally, throughout this description, the term "cargo" is used and defined as items for transport using the train 100. For example, cargo may comprise objects, liquids, and other transportable goods, and should not be limiting. One or more of the cars 113 may be configured to transport cargo. As such, to transport such cargo, in some embodiments the leading locomotive 102 may comprise a locomotive consist, comprising a collection of two or more locomotives connected to each other in a series. Thus, for example, two or three locomotives may be provided at a front of the train 100 to lead the train 100 along the tracks 103. Each locomotive 102 in the consist comprises a body and track engaging wheels for moving cars 113. Of course, the number of locomotives leading the train 100 should not be limiting.

In any case, in some embodiments, the back end of the locomotive(s) 102 may be attached or coupled to move a series 104 of cars of the train 100. The locomotive(s) 102 may be a vehicle which comprises a power system for driving the track engaging wheels of the locomotive(s) 102 to move the locomotive(s) and the cars 113 along the tracks 103, thereby pulling the series 104 of intermodal containers on railroad tracks or rails 103, as is known in the art. The power system may be of any type, including but not limited to a diesel engine, an AC or DC generator powered by a diesel engine, a fuel cell, a battery, a flow battery, or any other system for providing locomotive power.

In some embodiments, a plurality of series 104 of cars 113 is provided. For example, a first series and a second series of wheeled cars 113 carrying intermodal containers may be provided in train 100. In some cases, therefore, to transport cargo, one or more additional locomotives or locomotive consists may be provided within the length of the train, such as represented by locomotives 102*a* in FIG. 1, to assist in moving the series 104 of intermodal containers. For example, an additional locomotive may be provided after a series 104 of cars 113. Alternatively, two or more locomotives 102*a* may form a locomotive consist to assist in moving a second series 104 of cars 113. For example, in the embodiment of FIG. 1, a leading locomotive 102 or consist configured to lead the train 100 along the tracks 103 is provided, and a following locomotive 102*a* or consist is located rearward of the leading locomotive 102 which is configured to assist in moving the train 100 along the tracks 103. Generally a second or following locomotive or locomotive consist 102*a* may be provided in any number of positions along the length of the train 100 to provide mid-train power. In some cases, the placement of one or more locomotives or locomotive consists 102 or 102*a* may be based upon the weight of the cargo or items being transported, or the number of cars 113 being transported. The number of locomotives in the train 100, however, should not be limiting. The locomotives 102, 102*a*, containers, and cars 113 are shown for illustrative purposes only and other configurations and quantities would be understood in the art.

As shown, the series 104 may have at least a first set 106 of stacked intermodal containers and at least a second set of stacked intermodal containers 108. For illustrative purposes only, each set 106-110 of stacked intermodal containers as herein described comprises a top container 112 stacked or mounted on a bottom container 114, also referred to herein as a double stack. The mounting and/or locking of top and bottom containers 112 and 114, respectively, to each other in a stack is generally known in the art, as is discussed further below. However, it is to be understood that each car 113 may carry one, two, or three intermodal containers or no intermodal containers, and, as such, the configuration of stacking should not be limiting. Though the Figures illustrate a plurality of intermodal containers provided on the cars 113, it should be noted that it is envisioned that only some or none of the containers may be included in the train 100. That is, train 100 may include cars 113 designed to carry many types of cargo and/or types of containers, and should not be limited to the illustrated embodiment. The cars 113 of each series 104 may be loaded or empty, single or stacked. The cars 113 may be any type of car and any combination of types of cars. For example, types of cars 113 in train 100 may include, but are not limited to, flat or gondola cars, hopper cars, and well cars. In some embodiments, one or more of the cars 113 may be configured to include an intermodal container for storing cargo.

Also, it is noted that an intermodal container, as herein described, is defined as a box container, bulk container, tank, or other storage device comprising a structure or frame that allows for stacking and mounting on top of one another. Generally such containers are also referred to as "ISO containers," as they are manufactured according to specifications from the International Standards Organization (ISO) and are suitable for multiple transportation methods such as truck and rail, or rail and ship. For example, known standards for such containers are ISO 1496, ISO 668, and ISO 6346. In some embodiments, the intermodal containers may be manufactured in accordance with ISO 668:1995 and ISO 6346:1995, both of which are hereby incorporated by reference in their entirety, as known at the time of filing. Further details regarding such a container are described below and with respect to FIGS. 2*a* and 2*b*.

In an embodiment, the first set 106 of containers is defined as a first, leading set of containers attached and adjacent to the locomotive(s) 102. In an embodiment, a second set 108 of containers may be the last or one or more trailing set(s) of containers in the series of containers in the train 100. Alternatively, and more typically, a plurality of intermediate sets of stacked intermodal containers 110 is also provided between the first set 106 and the second set 108. In an embodiment, one of the intermediate sets 110 of containers may be referred to as a second set. In another embodiment, a trailing set of containers may be referred to as the first set of containers. In any case, any number of intermediate sets of containers 110 may be provided between first set 106 and set 108, or between leading locomotive 102 and locomotives 102*a*. A few sets of containers 110 are shown in FIG. 1 for simplicity purposes only and should not be limiting.

In an embodiment, each set 106, 108, 110 of stacked intermodal containers may be provided on a stack car 113, for example. The stack car 113, also known as a double stack car or well car, is a railroad car that is designed to carry intermodal containers. The stack cars 113 are connected in series and are pulled (or pushed) by one or more locomotives 102 and/or 102*a*.

Figure 2A:
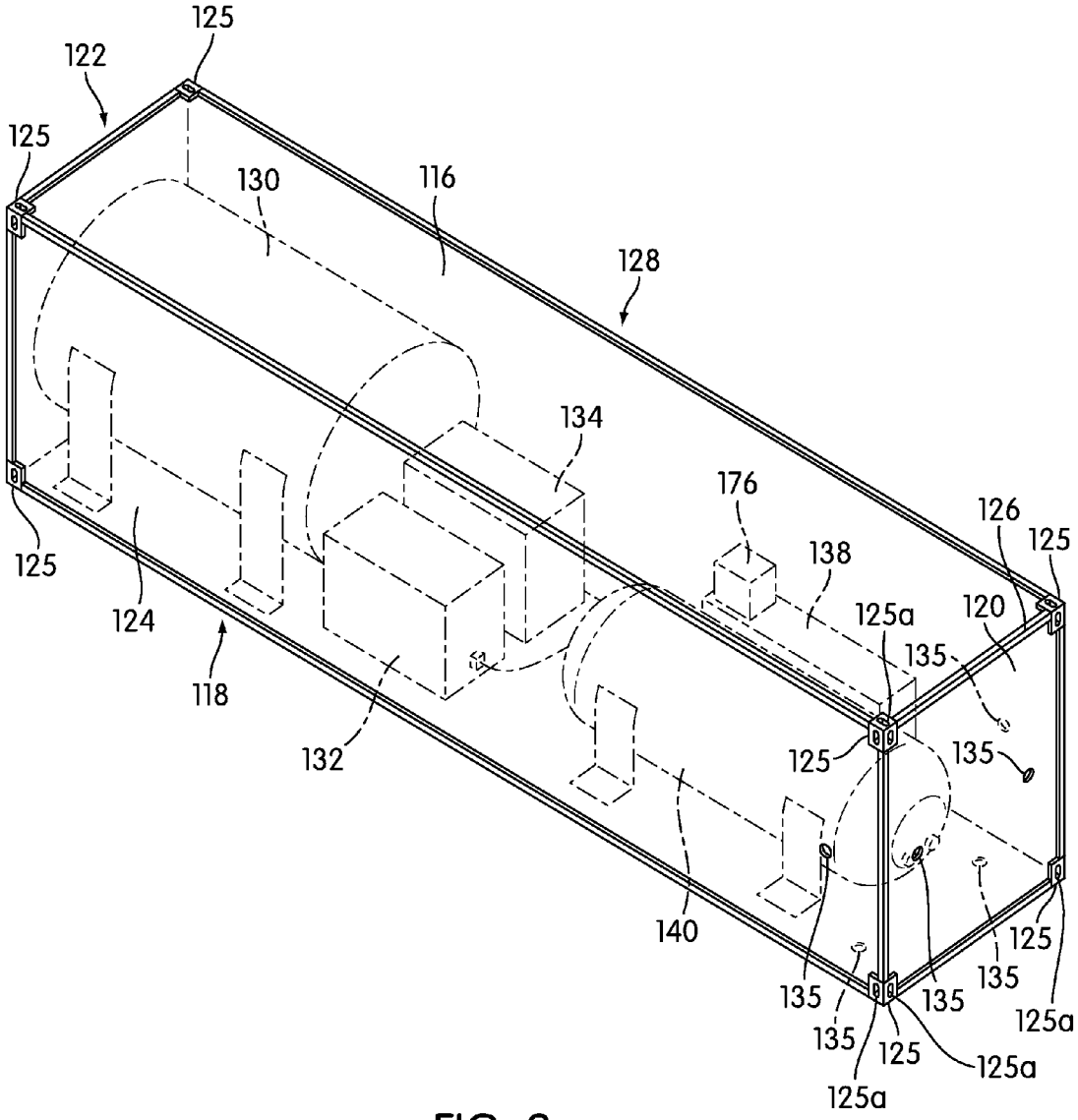
FIG. 2*a* illustrates a perspective view of a track lubricator, non-freight carrying, intermodal container with a lubrication system therein in accordance with an embodiment of the present invention.
Figure 2B:
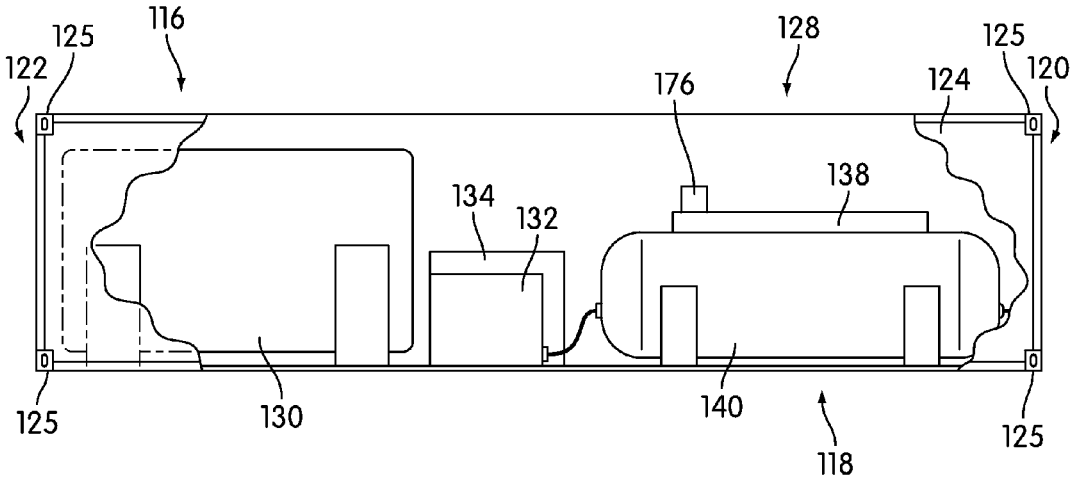
FIG. 2*b* illustrates a side cut-out view of the container of FIG. 2*a* comprising a lubrication system comprising at least lubricant holding tank, pump, control system, and power source in accordance with an embodiment of the present invention.

Each of the intermodal containers (e.g., such as containers 112, 114) comprises a top wall 116, a bottom wall 118, front wall 120, back wall 122, and side walls 124 connected by a frame 126 to form an enclosed box, for example, as shown in the FIGS. 2*a* and 2*b*. The container(s) as described herein may comprise various sizes and features. As generally known in the art, the side walls may comprise doors or openings allowing access to contents being held therein. The doors may be provided on a back wall, near the rear of the container, near the front of the container, on the sides of the container, or even access via the top of the container. Alternatively, a top wall may not be included. The dimensions or sizes of the containers should also not be limiting. For example, standard ISO shipping containers comprising dimensions of approximately 10 to approximately 53 feet long, approximately 8 feet to approximately 9 feet 6 inches high, and approximately 8 feet to approximately 8 feet, 6 inches wide may be used for transportation. Additionally, the type of product held by the containers should not be limiting. For example, though a box container is generally described herein, the device may be used with bulk containers typically 20 to 28 feet long and/or tanks designed to hold liquids with a holding capacity of 4000-6000 gallons.

Also, a structure or frame 126 of each of the containers or tanks may also facilitate stacking. Each container also comprises corner fittings 125 at each corner comprising a plurality of connection openings 125*a* or apertures. The "corner fittings" 125 are defined as fittings provided at a corner where the top wall 116/bottom wall 118 and side walls 124 meet. They may also be at a corner where the top wall 116/bottom wall 118, sides 124 and end walls 120/122 meet; however, that is not necessary. The corner fittings 125 and openings 125*a* are also in accordance with ISO standards. An example of such a standard for corner fittings 125 is ISO 1161:1984, which is hereby incorporated by reference in its entirety, as known at the time of filing. For example, in a standard 40 foot length ISO container, the corner fittings 125 are provided at the corners defined by a meeting of the top 116/bottom 118, side 124, and end walls 120/122. In a larger container, however, such as a 48 foot or a 53 foot length ISO container, two sets of corner fittings 125 may be provided—one set is provided at the corners defined at the meeting of the top 116/bottom 118 and side walls 124, and a second set is provided along the frame at an area that is spaced inwardly from the end walls 120/122. More specifically, the second set is spaced from the end walls 120 and 122 such that the corner fittings 125 are provided at a same location as a smaller, 40 foot length ISO container, for example. As is known in the art, this allows for intermodal containers to be stacked and connected to each other, despite their overall lengths.

The connection openings 125*a* are commonly used to connect or releasably lock the top container 112 to the bottom container 114 when mounted on each other to form a stack/double stack, for example. Devices such as twist locks or other rotatable locking devices which are insert into the openings 125*a* may be used to connect and lock containers to each other or to the cars 113. The connection openings 125*a* may also be used to lift a container. The connection openings 125*a* of the corner fittings 125 comprise an opening, hole, or aperture for receiving a securing, clamping, or connecting device. The opening, hole, or aperture 125*a* may be circular, oval, or any other shape, although they are typically elongated in shape. The corner fittings 125 are also designed to meet ISO standards and/or specifications. The corner fittings 125 may be made from a number of materials including, but not limited to, aluminum, stainless steel, and carbon steel. Generally, eight (8) corner fittings 125 are provided on a container (two top right, two top left, two bottom right, two bottom left).

FIGS. 2*a* and 2*b* illustrate the track lubricator, non-freight carrying intermodal container 128 with a lubrication system therein, in accordance with an embodiment of the present invention. As shown, an ISO intermodal container 128 is equipped with a suitable track or rail lubrication system that is installed inside the container 128. The non-freight carrying intermodal container 128 is used to lubricate a pair of rails of the train track 103. The container 128 comprises the same parts as a standard intermodal "ISO" container as described above. That is, the intermodal container 128 comprises a top wall 116, a bottom wall 118, front wall 120, back wall 122, and side walls 124 connected by a frame 126 to form an enclosed box or container body. In some embodiments, the container 128 may be manufactured in accordance with the above-incorporated standards, ISO 668:1995 and ISO 6346:1995, as known at the time of filing, for example. Corner fittings 125 are also provided at each corner comprising a plurality of connection openings 125*a* or apertures in accordance with ISO standards. For example, in embodiments, the corner fittings 125 of the track lubricator, non-freight carrying intermodal container 128 may be provided in accordance with the above-incorporated standard, ISO 1161:1984, as known at the time of filing.

The container 128 (and its corresponding fittings 125 and parts) may be of any size or dimensions, e.g., 40 feet in overall length, 48 feet in overall length, etc., and should not be limiting. In an embodiment, the container 128 is 20 feet in overall length. The intermodal container 128 may be used as a top or bottom container and mounted with another container (or two) to form a stack/double stack, for example. The container 128 can be placed on and transported in the same manner as conventional rail intermodal cars, such as in double-stack well cars.

The lubrication system in the container 128 is used to direct and distribute lubricant to at least a top of the rails (TOR) of the track 103. In some cases, the system (e.g., via nozzles) is positioned to direct the flow of lubricant toward wheels of the car (e.g., on the tread of the wheels). In an embodiment, the lubrication system provided within the intermodal container 128 may comprise equipment that is designed to distribute or disperse lubricant, the equipment and lubricant of which are both commercially available and known in the technology. In this exemplary embodiment, the lubrication system comprises at least a lubricant holding tank 130, a lubricant dispensing pump 134, a control system 138, and power source 132. Of course, the devices provided inside the intermodal container 128 should not be limiting. For example, an air compressor 140 may be provided to supply a source of pressurized air to the equipment (i.e., nozzles 160) for distributing lubricant. In some cases, the devices of the lubrication system are secured to at least a bottom wall 118 or floor of the inside of the container 128. As another example, in some embodiments, the lubrication system in container 128 may comprise elements such as those shown in U.S. Pat. No. 7,357,427 B2 to Eadie et al. and assigned to Kelsan Technologies, which is hereby incorporated by reference in its entirety.

The lubricant holding tank 130 is configured to hold lubricant that is to be applied to at least the top of the rails 103 of the track. Generally, the lubricant (or lube) is defined as a substance that is provided on at least the top of the rails of the track to reduce friction between the wheels of rail cars and the track. The lubricant within the tank 130 may be any type or number of lubricants and should not be limiting. Additionally, for example, one or more friction modifiers may be used as or with a lubricant on the rails of the track. A friction modifier is a chemical compound additive, for example, which may be added to lubricant(s) to reduce surface friction of the lubricated parts. Also, it is envisioned to be within the scope of this invention that the lubricant holding tank 130 may comprise more than one distinct storage areas in order to hold two or more types of lubricant, for example. The size of the tank(s) 130 should not be limiting.

The lubricant holding tank 130 may be connected to a lubricant dispensing pump 134 such that lubricant may be delivered through hoses 150 to the nozzles 160 pointed at the track 103. In some cases, a power source 132 may be provided to at least provide pumping action of the pump to the tank 130 (e.g., by activating, supplying, or increasing power delivery), such that lubricant is drawn and forced under pressure from the lubricant holding tank 130 and into the hoses 150 and out through the nozzles 160.

The type of power source 132 used with the lubrication system may be any type of power source, including, but not limited to, a generator, an onboard diesel engine, onboard battery(ies), using compressed air from train's automatic braking pipes, using compressed air from a rearmost locomotive's (i.e., the rearmost locomotive in a leading locomotive consist, such as locomotives 102) main air reservoirs, regenerative power such as electricity from electronically controlled pneumatic (ECP) brakes, and various other power sources. The power source 132 may be provided within the container 128, adjacent the container 128, or in a remote location with respect to the container 128. For example, in an embodiment, a diesel generator (e.g., DC flowing) is provided as the power source 132 within the container 128. In another embodiment, a 27-pin multiple unit (MU) transline cable may be connected to an adjacent locomotive and then to the container 128 such that the locomotive may supply power that may be used as the power source 132. In another embodiment, an air-powered generator, such as an air turbine, for example, may be provided in the container 128 and used as the power source 132. For example, an air hose may be connected to a main reservoir (MR) air line hose on an end of a locomotive that is adjacent to the container 128 and then to the container to provide air to power the generator. In yet another embodiment, it is envisioned that a power cable may be connected between the container 128 and one or more locomotives adjacent thereto such that power is received from electronically-controlled pneumatic (ECP) braking. As such, the above-described embodiments are exemplary and are not meant to be limiting.

The lubrication equipment that is provided within the intermodal container 128 is provided within an intermodal container comprising at least a floor structure with a plurality of hose openings 135 therein. As shown in FIG. 2*a*, for example, a plurality of hose openings 135 may be provided in the floor or bottom wall 118 of the container 128, as well as in the side walls 124 and front wall 120. The hose connection openings 135 in at least the floor/bottom wall 118 and/or the side walls 124 and/or front wall 120 facilitate passing rail lubrication hoses 150, nozzles 160, and the like from inside the container 128 to a position near or at the bottom of the car 113 (e.g., near or at the axle truck 115 or below a well body 142) so that the spray nozzles 160 can apply rail lubricant to at least the rail heads.

The control system 138 is provided to activate or deactivate of the flow of lubricant from the lubricant holding tank 130. The control system 138 may be used, for example, to control the amount of power (e.g., zero, some, all) to be sent from the power source 132 to pump 134, which thereby activates/deactivate the flow of lubricant (or friction modifier). As shown and described in the system diagram of FIG. 8, for example, the control system 138 may include at least a processor 172 (e.g., a microprocessor) and a controller 174 that communicate to start or stop the flow of lubricant to the nozzles 160. Generally, the use of such a system 138 is known in the art and therefore is not described in great detail herein.

In some embodiments, it is envisioned that the hose openings 135 may be connection openings that allow for one to connect delivery hoses 150 to the container 128 such that lubricant may be delivered from the lubricant holding tank 130 to the track 103. For example, although not shown, a number of hoses or delivery devices such as pipes may be provided inside the container from the tank 130 to one or more of the openings 135. Depending on which openings 135 are to be used, the delivery of the lubricant can be directed to the used openings 135, or alternatively, the delivery to openings 135 may be hindered via flow-stop devices. For example, it is envisioned that in embodiments, additional devices such as flow switches, sensors, and other devices may be incorporated with the control system 138 in order to control the flow or direction for sending the lubricant.

Figure 3:
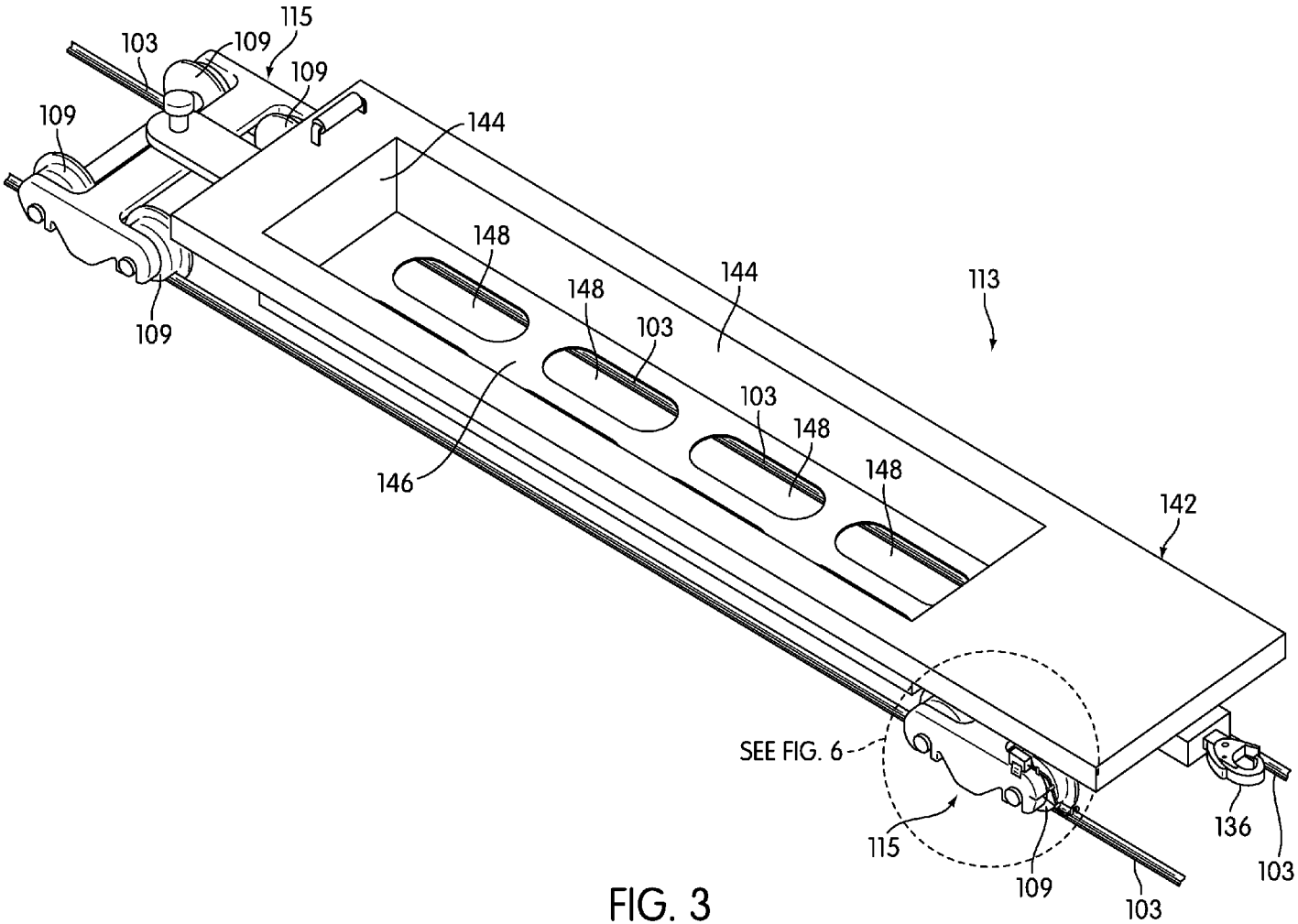
FIG. 3 illustrates a perspective view of a well car for holding the track lubricator, non-freight carrying, intermodal container of FIGS. 2*a* and 2*b* in accordance with an embodiment of the present invention.

In order to apply the lubricant to at least the top of the rails 103 (or rail heads), the lubricant intermodal container 128 may be placed inside a car 113 that allows for positioning of the hoses 150 and nozzles 160 towards the rails 103. In an embodiment, a stack or well car is provided. FIG. 3 illustrates an example of such a car. Stack cars typically have some type of semi-open floor(s) which may facilitate in passing lubricator nozzles, hoses, and other parts down through the car floor. For example, as shown in FIG. 3, a well car 113 may comprise a well body 142 formed from well walls 144 and a well floor 146. The well walls 144 and floor 146 form an area for receiving at least part of an intermodal container, such as container 128, therein. In some cases, the well floor 146 may include a plurality of openings 148 therein. As shown, the rails 103 may be easily seen through such openings 148. Thus, such a floor 146 may be utilized with the container 128, allowing for easy access to rail heads of the track 103 and for proper positioning of nozzles, hoses, etc. of the lubrication equipment of the container 128 such that it is properly aligned with at least the top of the rail (TOR). The car 113 generally also includes a pair of axle trucks 115 at each end, the trucks 115 including wheels 109 for movement along the pair of rails 103 when the train 100 is in motion. The type of axle trucks 115 used with the car 113 should not be limiting. For example, although not described in detail, it is to be understood that the trucks 115 may include two pair of wheels 109 connected by axles which are designed to be positioned and rotated/pulled along the track 103 (i.e., each truck may comprise 4 wheels). The trucks 115 may also include springs, brakes, bearings, rollers, and other parts and hardware as is known in the art.

Figure 9A:
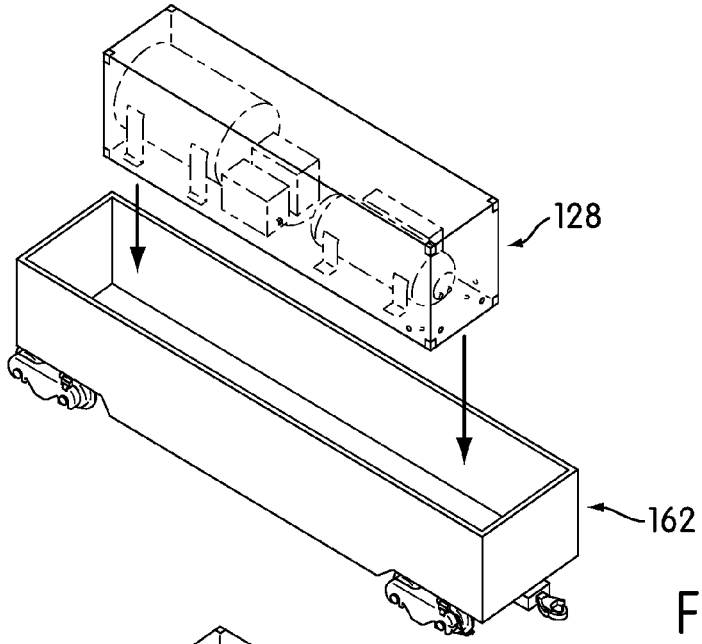
FIG. 9*a*, 9*b*, and 9*c* illustrate perspective views of alternative cars for mounting track lubricator, non-freight carrying, intermodal containers thereon in accordance with another embodiment of the present invention.
Figure 9B:
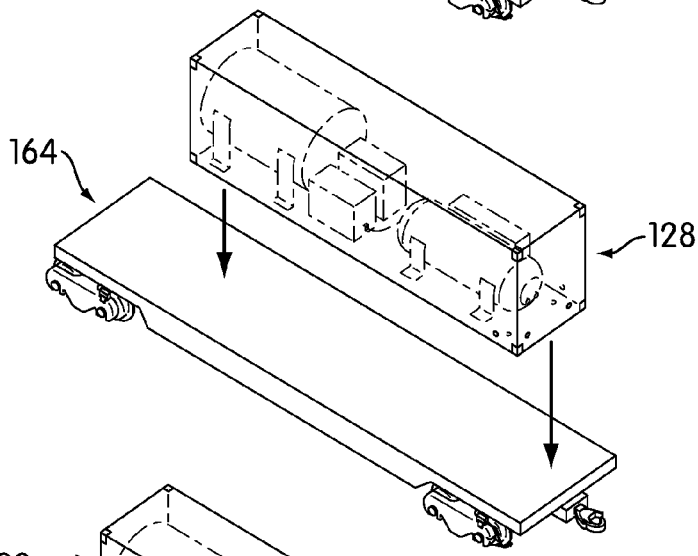
Figure 9C:
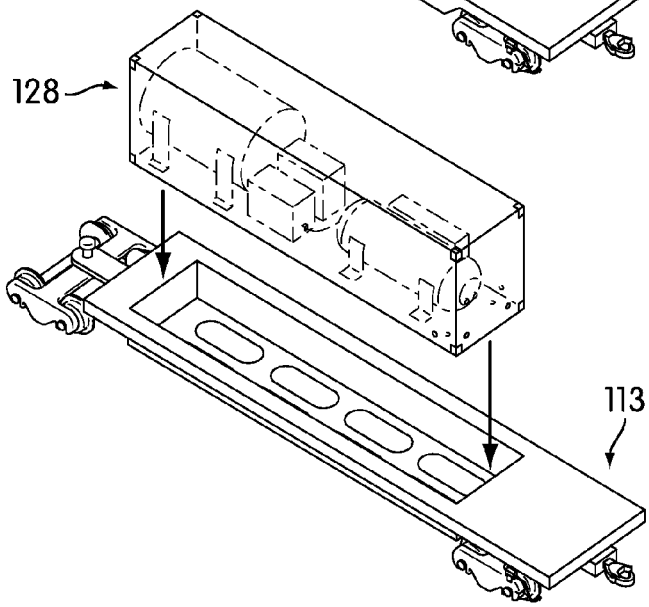

Of course, it is also noted that the well car as shown in FIG. 3 is for illustrative purposes only. Other details or features may also be included in or on the car 113. In fact, a stack car or well car as shown in FIG. 3 need not be used with track lubricator, non-freight carrying intermodal container 128. For example, in some embodiments, the container 128 may be provided on a gondola car 162 or a flat car 164, as shown in the exemplary embodiments of FIG. 9*a*, FIG. 9*b*, and/or FIG. 9*c*. Such cars are known in the art and therefore are not specifically described herein. Generally, however, the cars 113, 162, and 164 include a body and trucks 115 with wheels 109 for being directed along a track 103 comprising a pair of rails. Any of the noted configurations allow for positioning of the hoses and nozzles from the body of the container 128 such that the lubricant may be delivered to at least the rail heads of the track 103.

The delivery hoses 150 may be connected to the container 128 either inside or outside. That is, the hoses 150 may be connected directly to the lubricant holding tank 130, pump 134 and/or compressor 140, or they may be connected to one or more of the walls 116-126 of the container 128 itself, such that they may be directed and/or mounted on the well car 113. The nozzles 160 are positioned and mounted temporarily underneath the intermodal car body in a position to apply lubricant to at least the top of the rail. For example, the nozzles 160 may be positioned at an angle with respect to the top of the rail. FIGS. 4, 5*a*, 5*b*, and 6 illustrate example embodiments of how the nozzles 160, hoses 150, and other related equipment may be positioned to lubricate at least the top of the rails.

Figure 4:
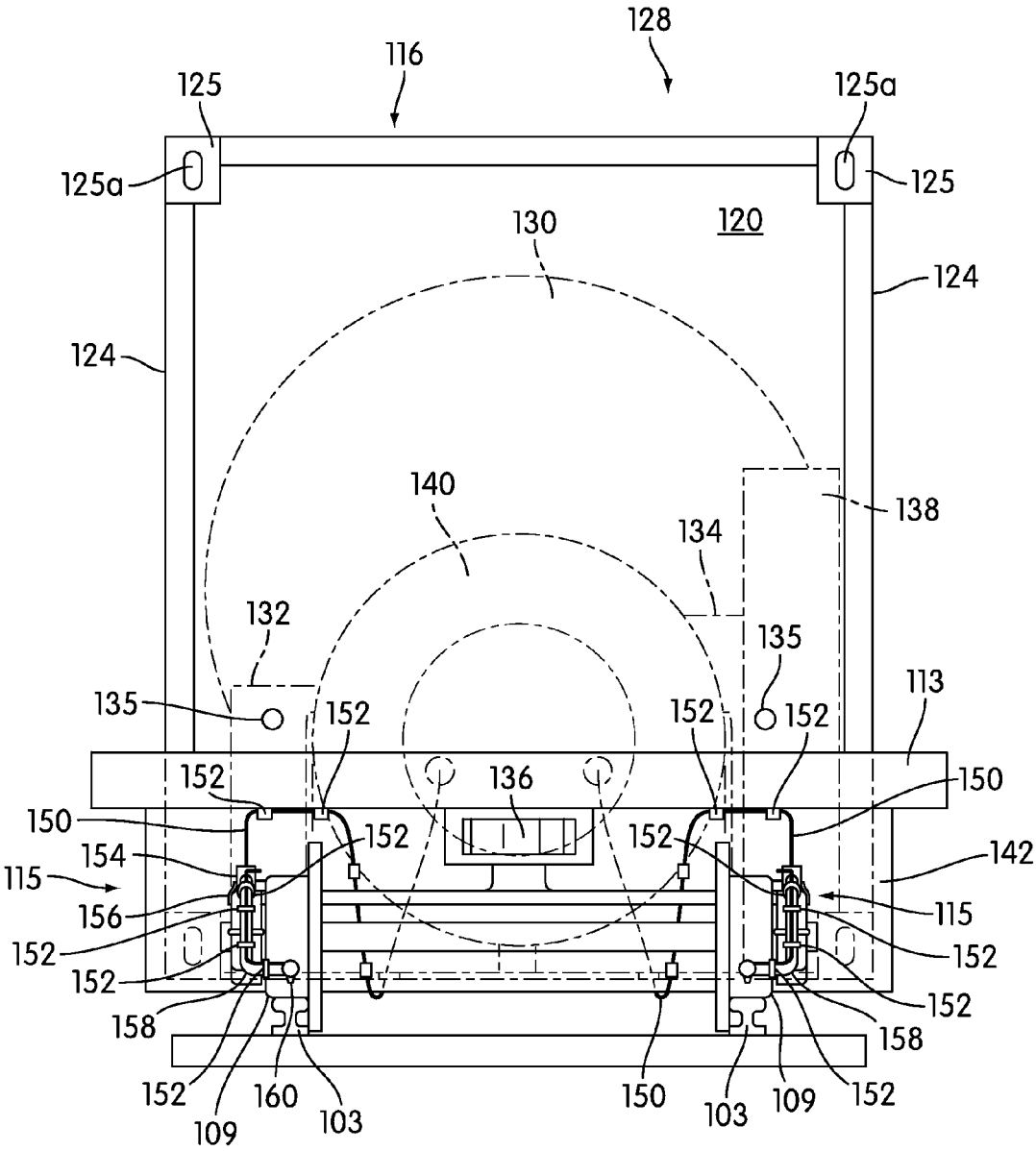
FIG. 4 illustrates an end view of the container of FIGS. 2*a* and 2*b* with its hoses and nozzles mounted and positioned from the container toward the rails of the track in accordance with an embodiment of the present invention.
Figure 5A:
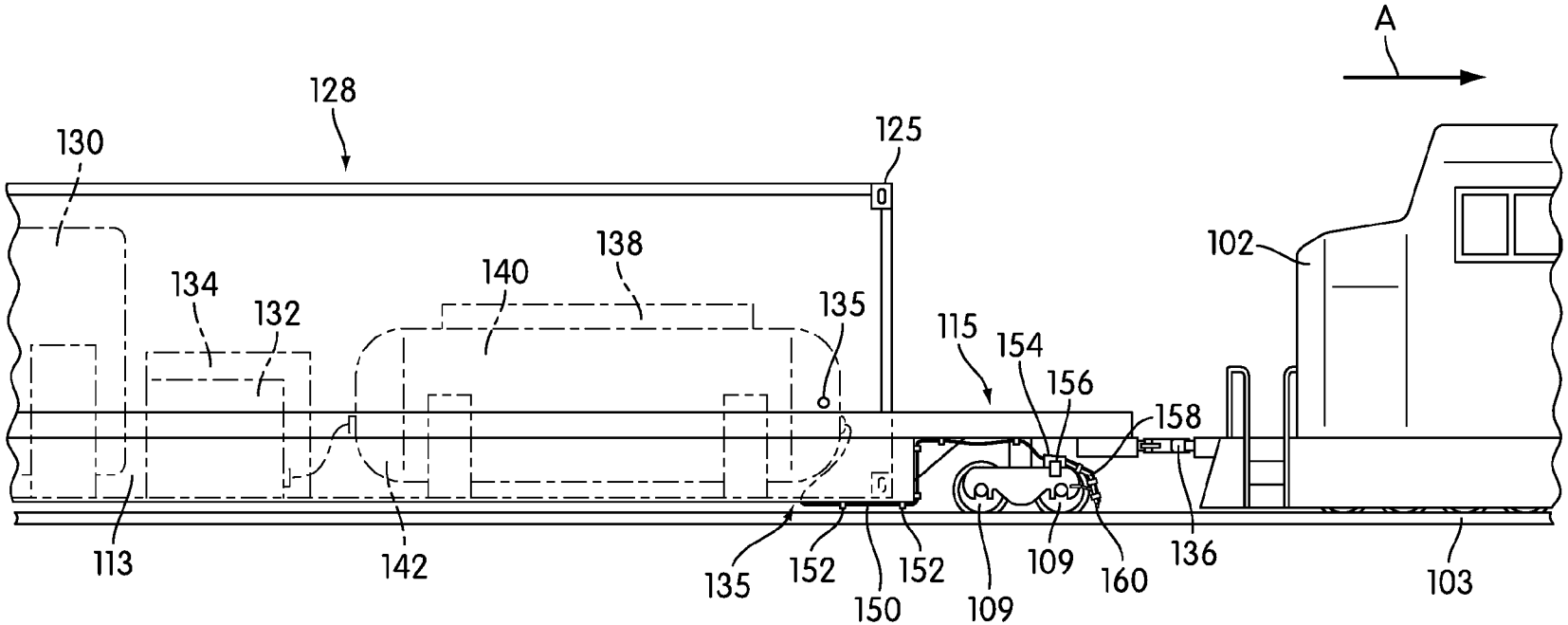
FIG. 5*a* illustrates a side view of the container of FIGS. 2*a* and 2*b* positioned in the train of FIG. 1 behind at least one locomotive with the lubrication system mounted to an axle truck in accordance with an embodiment of the present invention.
Figure 6:
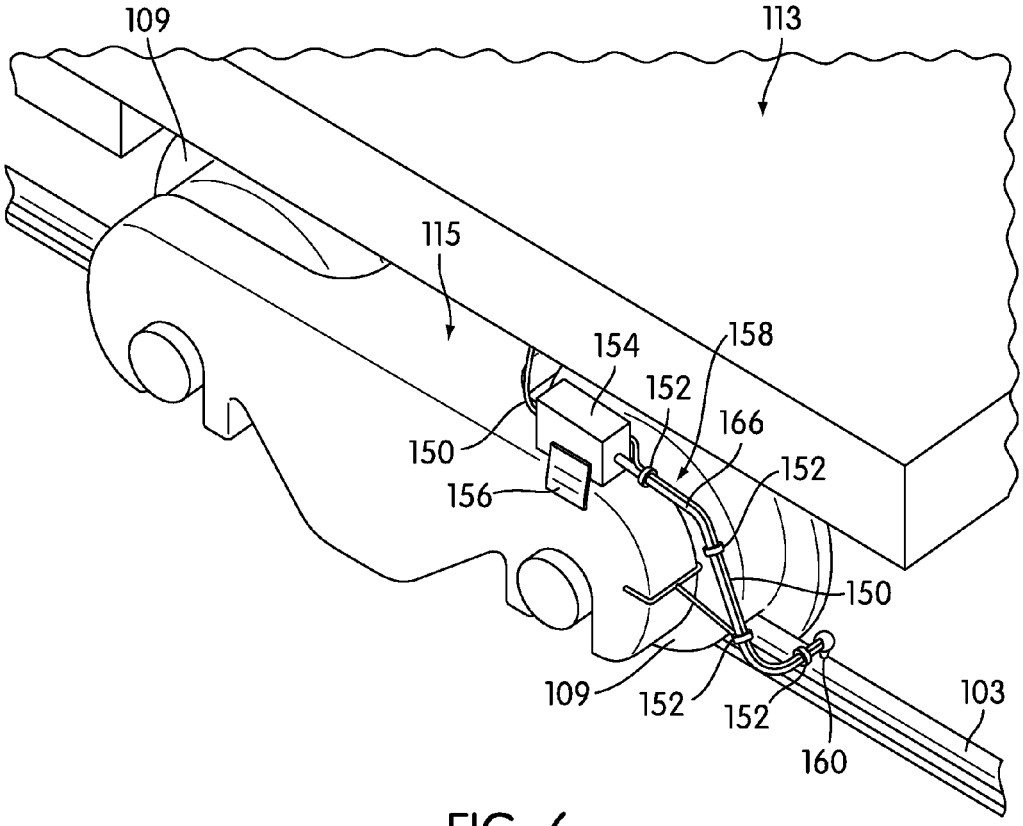
FIG. 6 illustrates a detailed perspective view of truck of the well car of FIG. 5*a* with the nozzles and hoses of the container mounted thereon in accordance with an embodiment of the present invention.

Specifically, as shown in the exemplary embodiment of FIGS. 4, 5*a*, and 6, the nozzles 160 and hoses 150 may be mounted to the axle truck 115 of a well car 113. More specifically, as shown by the end view of FIG. 4, hoses 150 and nozzles 160 are positioned and mounted on either side of a leading wheel axle such that the rails 103 are sprayed with lubricant as the leading wheels 109 are moving along the track. Although the following description describes the mounting and positioning of the equipment with respect to a first (e.g., right) side of the axle truck 115, it is to be understood that a similar configuration is applied to a second (e.g., left) side of the same axle truck 115 (as shown partially in FIG. 4). Additionally, although a single hose 150 and nozzle 160 are described as the delivery devices for each side of the truck 115, it is to be understood that additional hoses and/or nozzles could also be used in accordance with an envisioned embodiment.

In this embodiment, the hose 150 is directed through an opening 135 in the floor or bottom wall 118 of the container 128 and then through one or more of the plurality of openings 148 in the floor 146 of the car 113. The hose 150 may then be directed along the car body 142 toward the axle trucks 115 (see FIG. 5*a*). As shown in FIGS. 4 and 5*a*, for example, the hose 150 may be mounted to tacked to the car body 142 using mounting hardware 152 such as ties, hooks, fasteners, magnets, and other non-limiting securement devices for temporarily securing the length of the hose 150 and nozzles 160 to the car 113.

As shown in detail in FIG. 6, the hose 150 is directed and mounted on the axle truck 115 such that a nozzle 160 may be positioned toward the rail 103 of the train track. A mounting base 154 is provided to mount the hose 150 and a support structure 158 to the truck 115. In embodiments, the mounting base 154 is a base that is magnetic. The magnetic mounting base 154 is mounted to the truck 115 using its magnets and surrounding plates 156 which are attached to either side of the truck 115. The plates 156 assist in stabilizing the mounting base 154 to the axle truck 115 and may be mounted in any number of ways.

Attached to the mounting base 154 is the support structure 158 which is constructed to extend in a downward direction toward the rail 103 of the track. The support structure 158 may be attached to the magnetic mounting base 154 or to the axle truck 115, for example. The support structure 158 is provided to support the hose 150 which is used to deliver lubricant and/or friction modifier to the nozzle 160. The support structure 158 in this embodiment includes a diagonally and downwardly extending portion which is directed toward the top of the rail. The support structure 158 may further includes a support arm 166 which extends and is mounted to another part of the axle truck 115. Support arm 166 assists in stabilizing and thus limiting movement of the diagonally extending structure 158 as the train moves in a forward motion (e.g., as noted by arrow A in FIG. 5*a*). The support structure 158 in this embodiment may also include a curved portion which curves inwardly toward the top of the rail 103. The hose 150 may be mounted to the support structure 158 and its portions via mounting hardware 152 such that the nozzle 160 at the end of the hose 150 is properly aligned with at least the top of the rail 103.

Figure 5B:
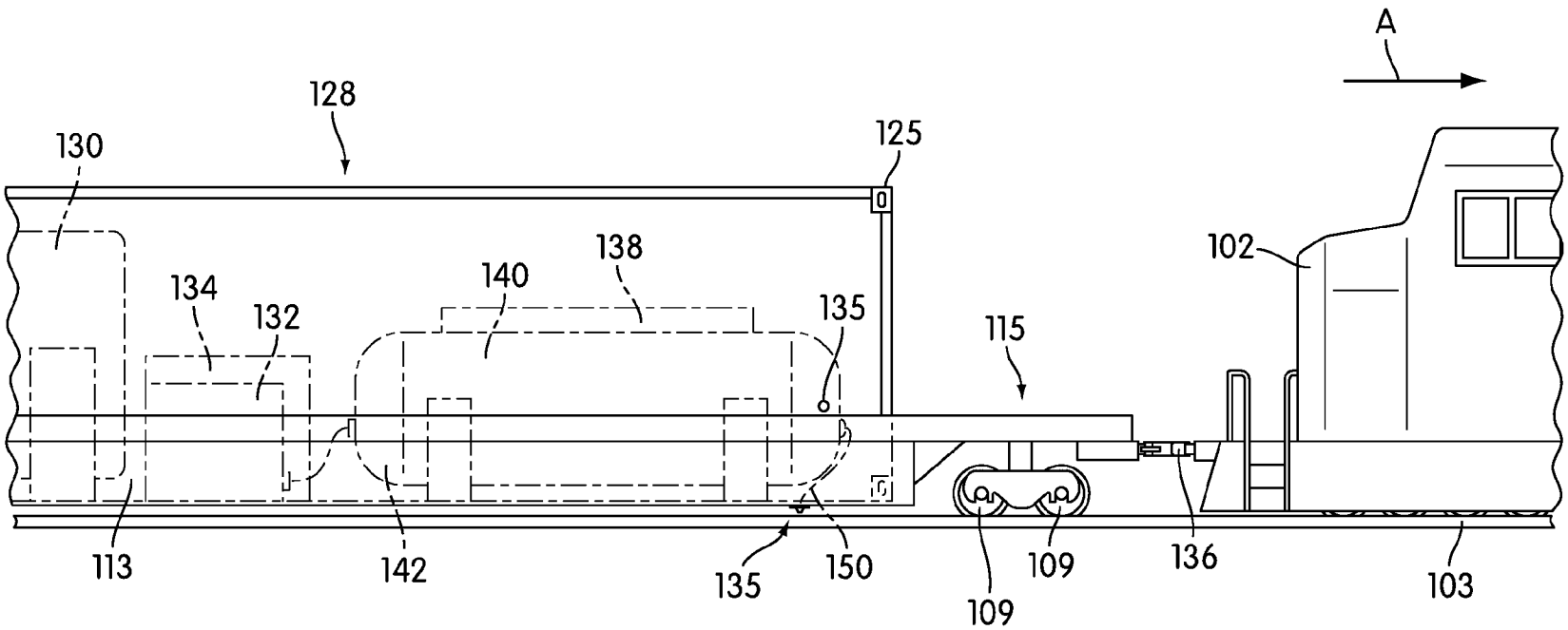
FIG. 5*b* illustrates a side view of the container of FIGS. 2*a* and 2*b* positioned in the train of FIG. 1 behind at least one locomotive with the lubrication system positioned with respect to the well car in accordance with another embodiment of the present invention.

Alternatively, as shown in the exemplary embodiment of FIG. 5*b*, the hose 150 is directed through an opening 135 in the floor or bottom wall 118 of the container 128 and then through one or more of the plurality of openings 148 in the floor 146 of the car 113, as described above, but the hose 150 and/or nozzle 160 is magnetically mounted to an underside of the car 113. For example, the hose 150 and/or nozzle 160 may be mounted with respect to an opposite side of the floor 146 or on an outside of the body 142 (i.e., inside of with respect to the axle truck 115). The hose 150 and nozzle 160 may be mounted using mounting hardware 152, a mounting base 154, plates 156, support structures 158 and 166 as described above, so as long as the nozzles 160 are positioned to spray at least the top of each of the rails 103 of the track when the lubrication system is prompted.

Figure 7:
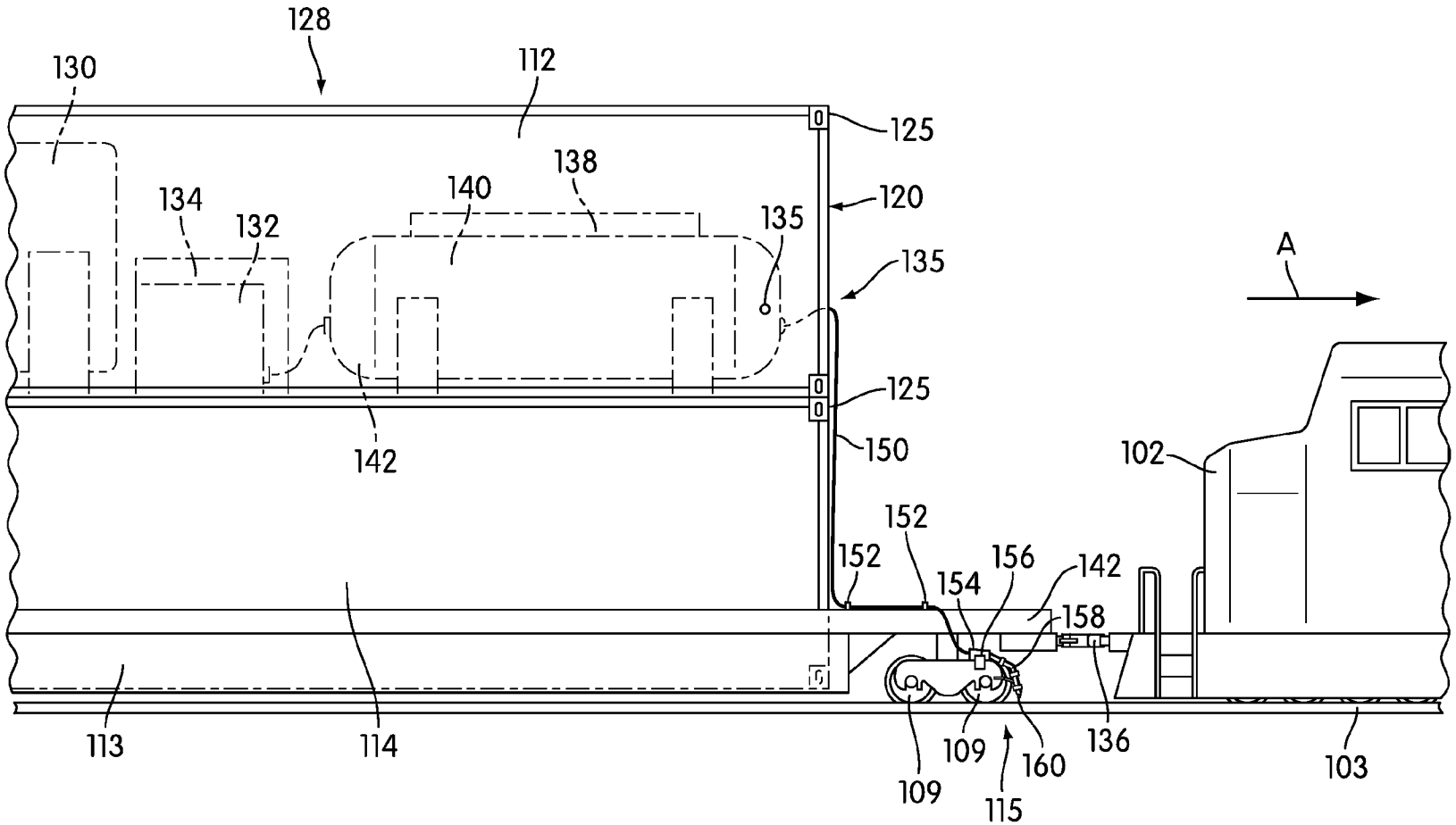
FIG. 7 illustrates a side view of the container of FIGS. 2*a* and 2*b* positioned in the train of FIG. 1 as a top container in a double stack behind at least one locomotive with the lubrication system positioned with respect to a well car in accordance with another embodiment of the present invention.

FIG. 7 illustrates a side view of the container 128 of FIGS. 2*a* and 2*b* positioned in the train of FIG. 1 as a top container in a double stack behind at least one locomotive in accordance with another embodiment of the present invention. Specifically, when the intermodal container 128 is placed as a top container 112 secured on top of a bottom container 114 in well car 113. As shown, the hose 150 is directed through an opening 135 in the front wall 120 of the container 128 and then directed or secured to the bottom container 114 and/or body 142 of the car 113, as described above. In some embodiments, the hose 150 and/or nozzle 160 may be mounted to truck(s) 115 of the car 113 using mounting hardware 152, a mounting base 154, plates 156, support structures 158 and 166 as described above, so as long as the nozzles 160 are positioned to spray at least the top of each of the rails 103 of the track when the lubrication system is prompted.

In order for the track lubricator, non-freight carrying intermodal container 128 to be most effective, it is beneficial for it to be positioned in or on a first car 113 (or first set 106) that is mounted or coupled adjacent to or behind the leading, working locomotive(s) 102. As shown in FIGS. 1 and 5, for example, a car 113 directly following the locomotive 102 is equipped with the container 128 at the bottom container. The container 128 may be coupled via couplings 136 or links for coupling the car 113 within the train 100.

In some embodiments, a large amount of cars may be provided in the length of the train. Therefore, as illustrated in FIGS. 1, 5*a*, 5*b*, and 7, for example, a container 128 may be coupled or mounted behind and relative to locomotive or consist 102 as well as relative to locomotive(s) 102*a*. For example, when mid-train power is supplied via locomotive(s) 102*a*, a container 128 in the first set 106 for the forward series of cars 104 may not apply a sufficient amount of lubricant for all of the cars within the length of the train 100, thereby causing the cars behind locomotive 102*a* to slip. Thus, in embodiments, cars located in a second or rear series 108 behind mid-train power from locomotive(s) 102*a* could have a top container 112*a* or bottom container 114*a* of the second set 108 of FIG. 1 as a (additional) track lubricator, non-freight carrying intermodal container 128 as described above to lube the rear rails/wheels of the train. Thus, a container 128 may be provided directly behind locomotive unit(s) 102*a* in a mid-train position, or other position along the length of the train, in addition to the first container 128 in the first set 106.

Figure 8:
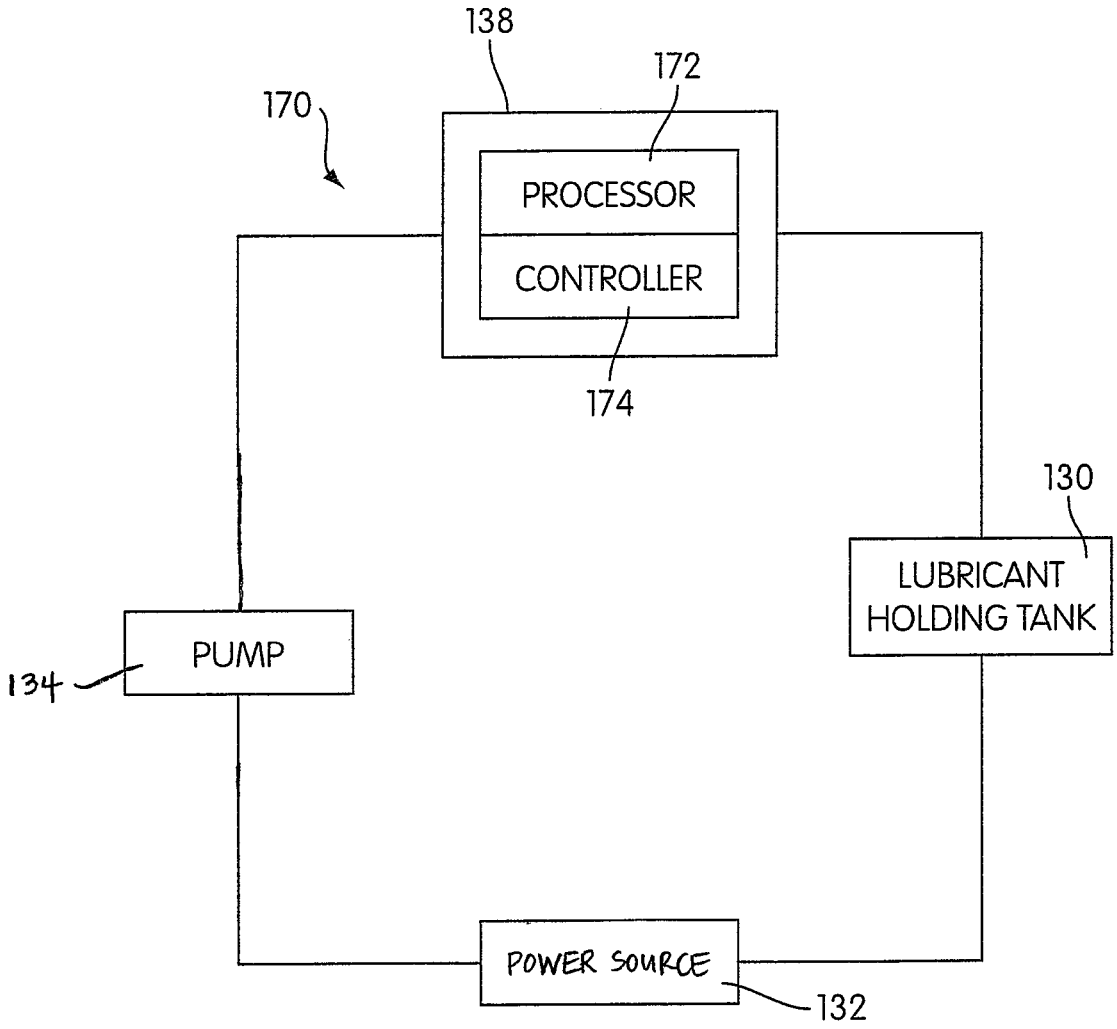
FIG. 8 illustrates a system diagram of the lubrication system in the track lubricator, non-freight carrying, intermodal container in accordance with an embodiment of the present invention.

FIG. 8 illustrates a system diagram 170 of the lubrication system which may be used in the track lubricator, non-freight carrying intermodal container 128 in accordance with an exemplary embodiment of the present invention. As shown and previously noted with respect to FIGS. 2*a* and 2*b*, for example, the system generally includes devices that are known in lubrication technologies. FIG. 8 illustrates the system diagram 170 including the control system 138, pump 134, power source 132, and lubricant holding tank 130 in communication with each other.

In some cases, the supply of lubricant to the track 103 may be periodically controlled. For example, it may be desirous to conserve the amount of lubricant by limiting the amount (i.e., quantity) of lubricant that is applied during a specific time period or in a specific location. In a possible embodiment, a communication device 176 (described in FIGS. 10*a*-10*c*) may be used to communicate with the controller 174 of the control system 138. The control system 138 or the controller itself 174 may be provided to control a circuit, system, or processor 172 by interpreting and executing instructions that are fed thereto. For example, instructions may be provided to a controller 174 for supplying, reducing, and/or stopping power fed to a power source 132. Such instructions may be provided wirelessly, for example. In an embodiment, the control system 138 or controller 174 may be used to turn the nozzles 160 on or off. In an embodiment, the power source 132 may include a system that is instructed by the control system 138 (i.e., the power source 132 receives instructions from the system 138) to begin supplying and applying a spray of lubricant via nozzles 160 (or, in some cases, to increasing the amount of lubricant being dispensed). The control system 138 and/or controller 174 may also be used to communicate and instruct the pump 134 of the lubrication system to withdrawal lubricant from the lubricant holding tank 130 and send it through hoses 150 to the nozzles 160 at a specific rate.

For purposes of this invention, a "communication device" is to be defined as any type of instrument, device, machine, or equipment which is capable of transmitting, acquiring, decrypting, or receiving any type of electronic, data, audio, radio transmissions, signals, or other communication information, or any part of a circuit, module, software, or other component that is capable of facilitating the transmission and receipt of information relating to the delivery of lubricant from the container 128 and its system elements. In an embodiment, the communication device 176 receives instructions based on a position of the train 100 along track 103. In an embodiment, the device 176 may receive instructions based on sensed conditions by sensors. As will be described, the communication device 176 may receive instructions via radio frequency (RF) communication via an antenna or a global positioning system (GPS) via satellite, for example. Of course, the methods of receiving such communication for supplying and applying lubricant to the rails 103 should not be limited to the disclosed embodiments.

Figure 10A:
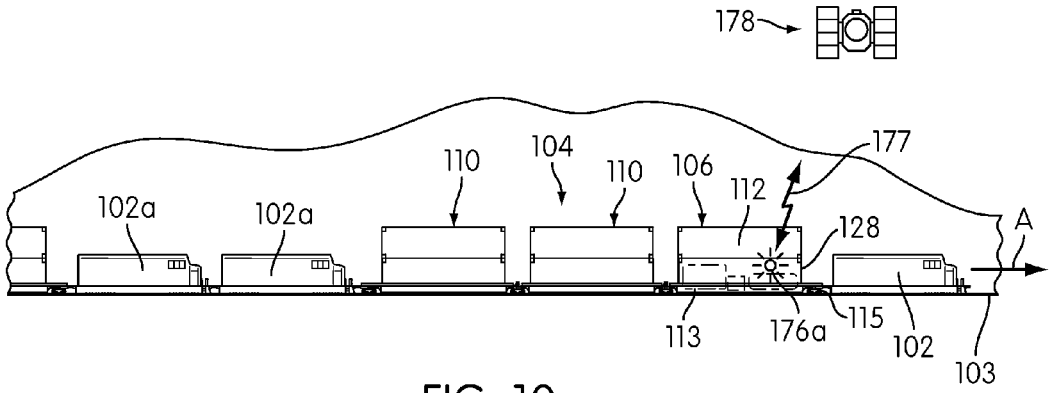
FIGS. 10*a*, 10*b*, and 10*c* illustrate examples of the track lubricator, non-freight carrying, intermodal container using communication systems in accordance with embodiments of the present invention.
Figure 10B:
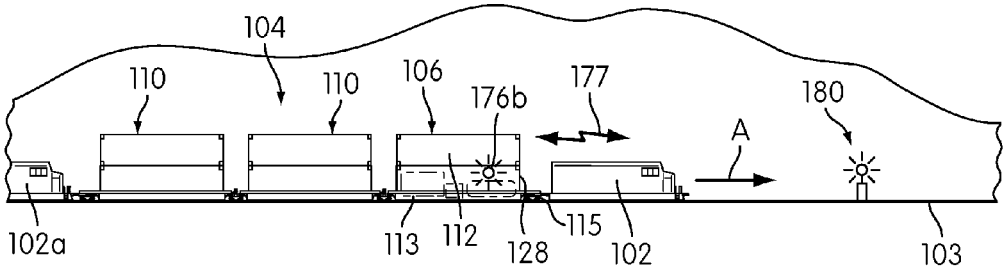
Figure 10C:
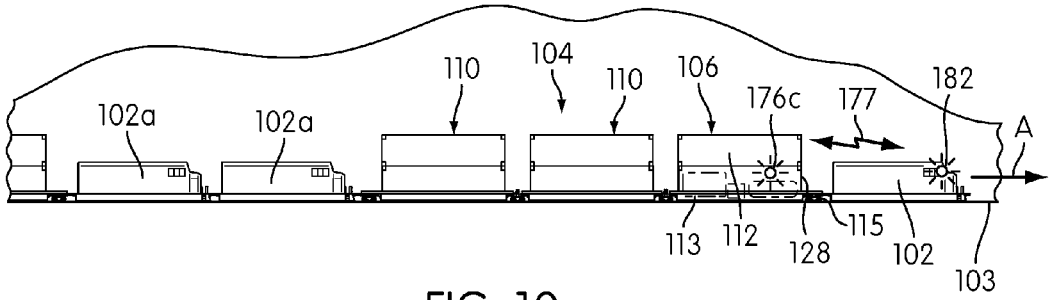

FIGS. 10*a*, 10*b*, and 10*c* illustrate examples of the track lubricator, non-freight carrying intermodal container 128 in train 100 of FIG. 1 using communication devices when traveling along a train track 103 in accordance with embodiments of the present invention. For example, container 128 may comprise a communication device 176 that is used to activate the dispensing or application of lubricant from the tank 130 and to the rails 103 via hoses 150 and nozzles 160. The communication device 176 may be used to determine a location along the train track to activate the flow of the lubricant or friction modifier, for example. The communication device 176 may be provided in any area of the container that is capable of effectively receiving signals. The device 176 is configured to receive instructions 177 for supplying power, for example. More specifically, the communication device 176 may be connected to a controller (shown as system 138 in FIG. 2*b*, and element 174 in FIG. 8) in the container 128 for supplying power to pump 134, and thus supply lubricant to at least the top of the rails of track 103 (or rail heads) (i.e., activating or deactivating supply of lubricant).

For example, the wireless communication device 176 may receive instructions 177 based on its position along a route or track 103. After the instructions 177 are received, power may be supplied. The instructions 177 that are received may also instruct the controller (or other device) to limit or stop the power supply from the power source 132 after a certain period of time, thereby limiting the generation of airflow as it exits the tunnel. In some cases, a second signal may be provided to limit or stop the lubricant application.

FIG. 10*a* illustrates an embodiment of the container 128 being equipped with a communication device 176*a* having a global positioning satellite (GPS) receiver or technology for communicating 177 with a satellite 178 to determine its location. In some cases, for example, a controller 174 of the lubrication system in the intermodal container 128 may have known coordinates for one or more locations provided along a track 103 programmed therein to supply the lubricant. This may allow the controller/power source 132 to supply power according to such coordinates, thereby activating or deactivating the supply and/or application of the lubricant to the top of the rails 103, for example.

Additionally, the GPS technology provided by the device 176*a* may be used in an exemplary embodiment to enable detection of curved versus tangent portions of the track 103. That is, the train 100 may be moving in a route which includes rails 103 which are curved. As such, the angles at which the nozzles 160 are positioned, for example, may need to be controlled. The GPS technology provided on the intermodal container 128 may, in some embodiments, be used to control the supply and/or application of rail lubricant for specific track configurations. For example, the controller 174 may send and receive communication regarding the angle or position at which the nozzle is directed (i.e., in order to direct the lubricant and/or friction modifier) towards the rails of the track.

In an embodiment, the wireless communication device may utilize radio frequency communication. FIG. 10*b* illustrates such an exemplary embodiment. The wireless communication device 176*b* may be in communication 177 with one or more short-range radio transmitters 180 mounted with respect to a location along the track 103. The communication device 176*b* of the intermodal container 128 may be a radio receiver, for example. In some cases, the transmitter 180 may be associated with a wayside inspection system, or some other kind of system, provided along the track.

In another possible embodiment, FIG. 10*c* illustrates an example of using a communication device 176*c* of the lubricant intermodal container 128 in communication 177 with a local communication device 182 provided in or on the train 100. For example, the lead locomotive 102 (or consist) may comprise a local communication device 182 for supplying instructions as noted by arrow 175 to the wireless communication device 176*c* for controlling the power source 132 and/or compressor 140 of lubrication system. Power to the lubrication system may be supplied in a similar manner as noted above (i.e., power supply is turned on to supply and apply lubricant on rails 103 at a location, turned off at another location or after an amount of time). Of course, the local communication device 182 may be provided in any number of locations along the train, including, but not limited to: on the leading locomotive(s) 102, in or on a car 113, on an operator, in a locomotive control board, etc. The device 182 may be automatically operated (e.g., using pre-programmed conditions) or manually operated (e.g., using an operator or engineer) to communicate 177 instructions to wireless communication device 176*c*. In some instances, the communication device 176*c* may be radio controlled from the locomotive 102. For example, voice radio may be used to communicate with device 176*c*, thereby instructing activation of the lubrication equipment to generate a flow of lubricant. In some instances, a "radio tone" created by a keypad or keyboard may be used to toggle on/off commands to the communication device 176*c* and controller. It is also envisioned that the local communication device 182 may implement a plurality of methods and devices. For example, voice radio may be used to send instructions to device 176*c*, but a keypad for manual override may be provided as well. Use of such a local communication device 182 allows for customized activation or deactivation of the supply or activation of the lubricant from the lubrication system of the intermodal container 128.

Of course, if an additional lube container 128 was provided behind the locomotive(s) 102*a* within the length of the train, that container too could use any type of communication or activation device, such as those noted in FIGS. 10*a*-10*c*, for powering and supplying lubricant (or friction-modifiers) to the rails of the track 103.

The methods and/or devices used to control or communicate with the intermodal container 128 and its components should not be limited to the described embodiments. Also, any of the above wireless technologies and communication devices may be used alone or in combination with other devices for accurately supplying and applying lubricant to the rails of the track 103.

It should be noted that the design of the track lubricator, non-freight carrying intermodal container 128, lubrication system and its parts, car 113, or mounting structures (e.g., mounting base 154, plates 156, support arm 158) should not be limited to those mentioned, and it is envisioned that several designs may be used. Additionally, the materials used to manufacture the container 128 and its associated devices should not be limiting. For example, in some embodiments, the mounting structures may comprise materials such as aluminum or other metals.

The herein described container 128 system and method provides several advantages. Generally, lubricating rails reduces resistance, reduces wheel wear, and can achieve improvements in freight train fuel efficiency by reducing rail car wheel steering forces, thus reducing the rolling drag or load on the propelling locomotives (i.e., leading locomotive(s) 102). By providing the lubrication equipment within an ISO standard intermodal container, additional advantages are perceived.

For example, the intermodal container 128 allows for easy replacement and positioning of the container 128 along the length of the train 100 due to its corner fittings 125. For example, the modified intermodal container 128 may be moved and positioned in any of the cars 113 when parked at a yard. Also, there is no need to adjust or manufacture special devices when using the intermodal container 128. The interface between the modified intermodal container 128 and rail car 113 (e.g., well or stack car, gondola car, or flat car) remains the same.

Additionally, using a container 128 as disclosed herein provides a relatively easy method of providing onboard lubrication for high-speed intermodal container trains, without disadvantages of mounting equipment onboard locomotives or freight cars. For example, as previously noted, locomotive-mounted schemes and freight car-mounted schemes require careful managing to place the loaded devices in the correct position at rear of a consist (i.e., the lubrication equipped locomotive or lubrication equipped freight car must be provided in a specific position). The intermodal container 128 allows for easy movement of the lubrication equipment along the length of the train 100.

More specifically, the lubrication container 128 allows for handling and movement in a rail yard using existing equipment, i.e., container cranes, drayage chasses, lift devices, spreader beam structures, and tractors. No yard switcher locomotive or crew activities are required. For example, in the instance when a train arrives at its destination and is parked for unloading, the intermodal container 128 can be removed from the ("inbound") car 113 of the first-set 106 at a first end, placed onto a container chassis and pulled by a yard tractor to the other end of the yard. The container 128 may then be lifted from the container chassis and placed in or on a car 113 at the second end (now other end, which will be the leading end upon departure of the train) of the same train—or in/on a car 113 of another train on another track—and, thus, the container 128 is repositioned for "outbound" use in direction that is opposite that in which it arrived. The nozzles 160 may be adjusted and positioned after mounting in the car 113. Before leaving the yard, the lubrication system may be activated.

Using the rail yard equipment is advantageous for a number of reasons. For example, such equipment exists in rail yards and thus need not require special devices for moving or mounting the intermodal container 128. Modifications of rail yard equipment are not required. Using such equipment also reduces the amount of effort and manpower required. For example, in some embodiments, only a crane operator and ground operator are required.

The intermodal container 128 is also advantageous as it is designed such that it may be easy to install by operators as the container need not be adjusted or modified since it uses existing holes and openings (e.g., corner fittings 125) and equipment. The intermodal container 128 also allows for simplified installation (or removal) without risk of harm or injury to the container or the operators.

The containerized approach of the lubrication equipment in the container 128 provides an application that it easily maintained and decreases maintenance costs because if the onboard rail lubrication equipment in the container 128 becomes defective, the entire intermodal container 128 can be hauled (e.g., via highway chassis and tractor) to a repair point or location, instead of the difficulty and cost of taking a lubrication-equipped locomotive to a locomotive repair shop, or a lubrication-equipped rail freight car to a rail car repair shop. Furthermore, the cost for installing lubrication equipment in the intermodal container 128 is quite low compared to the traditional locomotive or freight car approach, as it requires little to no adjustment of the intermodal container itself, the cars 113 at which it is mounted, and minor costs for the devices used to mount the hoses, nozzles, etc. with respect to the axle trucks 115 of the cars 113.

Also, installation of the lubrication system within the intermodal container contains the equipment, and helps reduce shock and vibration to the equipment.

The use of a modified intermodal container 128 as the vehicle for carrying the rail lubrication equipment also provides fuel efficient benefits. For example, the lubrication (and/or friction modification) of at least the top of the rails allows the rail car wheels to find their "natural," lowest-friction position laterally (i.e., crosswise or perpendicular to the direction of the tracks) on the rails on both tangent and curved tracks. As such, by reducing the friction via lubricant at the wheel-rail interface, the rail cars are more easily directed and pulled/pushed along the track, thereby reducing the amount of fuel required to move the cars in the train.

It is also known in the art that containers of different dimensions may be stacked. For example, a top container having a different length than a bottom container may form a set 106, 108, or 110 of containers. The containers of greater length, as noted above, generally comprise two sets of corner fittings. In any case, it is to be understood that the lubrication system may be contained within an intermodal container of any length, and may also be used as a top container in a stack. For example, openings 135 in the side walls 124 and/or front wall 120 allow for the positioning of hoses 150 downwardly toward the track 103. The hoses 150 could be mounted via mounting structures 152 along the container bodies or doors, frames 126, or doors, for example.

Additionally, it is envisioned that in an embodiment that the lubrication system may be provided in an aerodynamic pseudocontainer for reducing drag. For example, when the non-revenue container is provided as a top container 112 in a first stack 106 behind a locomotive or locomotive consist 102, the container (with lubrication system therein) may comprise features such as shown in U.S. application Ser. No. 12/394,609, filed Feb. 27, 2009, and assigned to the same assignee.

While the principles of the invention have been made clear in the illustrative embodiments set forth above, it will be apparent to those skilled in the art that various modifications may be made to the structure, arrangement, proportion, elements, materials, and components used in the practice of the invention.

For example, in addition to any of the above mentioned features, in some embodiments, standard ISO containers may comprise an attachment area known as a tunnel or gooseneck tunnel (not shown), extending from a first end of the container toward a second end of the container. In an embodiment, the tunnel may include frame members on either side to define the gooseneck tunnel. The tunnel is traditionally designed to receive or accommodate a part of an over-the-road trailer or chassis.

Additionally, although not shown in the Figures, the container 128 may include one or more sensors. For example, any number of sensors or sensing devices/systems may be provided to determine a flow rate of the lubricant, an amount or capacity of lubricant within the lubricant holding tank 130, overheating of equipment, failure of equipment, failure of nozzles 160 and/or hoses 150 to provide a sufficient amount of lubricant, and the like. Also, sensors may be used with or in place of the wireless communication devices **176*a*-176*c*** to activate/deactivate the supply and application of the lubricant.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A non-freight carrying intermodal container system with a lubrication system therein for lubricating a pair of rails of a train track, the container system comprising:

a non-freight carrying body formed from a top wall, a bottom wall, front wall, back wall, and side walls connected by a frame, the body configured to house the lubrication system;

corner fittings at each corner of the body forming the intermodal container, the corner fittings comprising a plurality of connection openings, and the lubrication system comprising at least a lubricant holding tank inside of the body for holding lubricant, a lubricant dispensing pump for pumping lubricant from the tank, and one or more hoses connected to the lubricant holding tank for directing a flow of the lubricant to one or more nozzles connected to the one or more hoses, wherein the container is provided on a car for moving the container along the train track, wherein the one or more nozzles are configured to distribute and direct the flow of lubricant towards wheels of the car and onto at least a top of the pair of rails, and wherein the one or more nozzles are mounted on trucks carrying the wheels of car using a magnetic mounting base and surrounding plates, each magnetic mounting base positioned above an axle of the wheel and the surrounding plates attached to either side of the trucks to assist in stabilizing the magnetic mounting base above the axle and on the truck.

2. The non-freight carrying intermodal container according to claim 1, wherein the car comprises a car body and a car floor, the car floor comprising a plurality of openings, and wherein the one or more hoses are directed from the lubricant holding tank through at least one of the plurality of openings in the car floor and toward the pair of rails.

3. The non-freight carrying intermodal container according to claim 1, wherein the lubrication system further comprises a global positioning system for determining a location along the train track to activate the flow of the lubricant.

4. The non-freight carrying intermodal container according to claim 1, wherein the lubrication system further comprises a controller and a power source, the power source being connected to the pump, and the controller sending instructions to the power source to distribute lubricant onto the rails.

5. A lubrication system for lubricating a pair of rails of a train track using a non-freight carrying intermodal container, the container having a body comprising a top wall, a bottom wall, front wall, back wall, and side walls connected by a frame, and having corner fittings at each corner, the corner fittings comprising a plurality of connection openings, and the lubrication system comprising:

at least a lubricant holding tank inside of the body of the intermodal, non-freight carrying container for holding lubricant, a lubricant dispensing pump for pumping lubricant from the tank, and one or more hoses connected to the lubricant holding tank for directing a flow of the lubricant to one or more nozzles connected to the one or more hoses, wherein the lubrication system and the container are provided on a car in a train that is configured to move along the train track, wherein the one or more nozzles are configured to distribute and direct the flow of lubricant towards wheels of the car and onto at least a top of the pair of rails, and wherein the one or more nozzles are mounted on trucks carrying the wheels of car using a magnetic mounting base and surrounding plates, each magnetic mounting base positioned above an axle of the wheel and the surrounding plates attached to either side of the trucks to assist in stabilizing the magnetic mounting base above the axle and on the truck.

6. The lubrication system according to claim 5, wherein the car comprises a car body and a car floor, the car floor comprising a plurality of openings, and wherein the one or more hoses are directed from the lubricant holding tank through at least one of the plurality of openings in the car floor and toward the pair of rails.

7. The lubrication system according to claim 5, wherein the lubrication system further comprises a global positioning system for determining a location along the train track to activate the flow of the lubricant.

8. The lubrication system according to claim 5, wherein the lubrication system further comprises a controller and a power source, the power source being connected to the pump, and the controller sending instructions to the power source to distribute lubricant onto the rails.

* * * * *